US006474481B1

(12) United States Patent
Liu

(10) Patent No.: US 6,474,481 B1
(45) Date of Patent: Nov. 5, 2002

(54) FLEXIBLE TOOL STORAGE DEVICE

(76) Inventor: Yung-Yuan Liu, No. 9, Lane 1397, Guangshing Rd., Taiping City, Taichung (TW), 411

( * ) Notice: Subject to any disclaimer, the term of this patent is extended or adjusted under 35 U.S.C. 154(b) by 0 days.

(21) Appl. No.: 09/875,913

(22) Filed: Jun. 8, 2001

(51) Int. Cl.[7] ..... A47F 5/00

(52) U.S. Cl. ..... 211/69; 211/70.6; 211/60.1; 206/377; 206/379

(58) Field of Search ..... 211/70.6, 74, 60.1, 211/69; 206/372, 377, 379

(56) References Cited

U.S. PATENT DOCUMENTS 3,709,429 A * 1/1973 McKenzie et al. ..... 211/74 X
5,080,232 A * 1/1992 Leoncavallo et al. ..... 211/74 X
5,525,314 A * 6/1996 Hurson ..... 211/69 X
5,566,596 A * 10/1996 Lin
5,579,929 A * 12/1996 Schwartz ..... 211/74
5,996,818 A * 12/1999 Boje et al. ..... 211/74
6,050,409 A * 4/2000 Delbeck et al. ..... 206/375
6,065,598 A * 5/2000 Anderson ..... 206/378
6,112,897 A * 9/2000 Hu ..... 206/377
6,132,684 A * 10/2000 Marino ..... 211/74 X

* cited by examiner

*Primary Examiner*—Robert W. Gibson, Jr.
(74) *Attorney, Agent, or Firm*—Rosenberg, Klein & Lee

(57) ABSTRACT

A flexible tool stage device is provided. The flexible tool storage device includes a storage body wich has multiple circular recesses. An insert opening is defined inside of each circular recess, thus a cylindrical constraint tube body is defined between each circular recess and the insert opening corresponding thereto. Each constraint tube body having an internal diameter slightly less than a diameter of an excircle of a shank of a working portion of a tool to be inserted. Each constraint tube body has multiple slots defined along a longitudinal direction thereof and equally distributed thereon. When a tool is inserted through the insert opening, the diameter of the insert opening of the cylindrical constraint body will be enlarged and then a recovery force from the cylindrical constraint body will be urged to stably retain the tool.

4 Claims, 6 Drawing Sheets

FLEXIBLE TOOL STORAGE DEVICE

BACKGROUND OF THE INVENTION

1. Field of the Invention

The present invention relates to a flexible tool storage device and more particularly, to a flexible tool storage device providing with more stable retaining for tools.

2. Description of the Related Prior Art

A conventional tool storage device is disclosed in FIG. 6 including a storage body 60. The storage body 60 has multiple insert openings 62 defined thereon. Most of the tool storage devices are made of plastic material. Thus, the diameter of the insert opening 62 can be slightly less then the diameter of the excircle of the polyhedron shank 310 of the working portion 31 so hat the working portion 31 can be more stably retained in the insert opening 62.

However, most of the working portions 31 have to be drawn out from and inserted in the corresponding insert openings 62 frequently. After using it a period of time, the insert openings 62 will be enlarged by abrasion between it and the metal tool working portion 31. A tool working portion 31 is liable to drop from an enlarged insert opening 62 or even cannot be retained in the insert opening 62.

SUMMARY OF THE INVENTION

It is found a disadvantage in the prior art of FIG. 6 that the tool working portion is liable to drop from an enlarged insert opening or even cannot be retained in the insert opening. Thus, there is still a need for improving the tool storage device of prior art.

Therefore, an object of the present invention is to provide a flexible tool storage device which provides more stable retaining ability.

To accomplish the object of the present invention, a flexible tool storage device is provided. The flexible tool storage device includes a storage body. The storage body has multiple circular recesses defined thereon. An insert opening is defined inside of each circular recess. Each circular recess has an internal diameter larger than a diameter of the insert opening whereby a cylindrical constraint tube body is defined between each circular recess and the insert opening corresponding thereto. Each constraint tube body 13 has an internal diameter slightly less than a diameter of an excircle of a shank 31 of a working portion of a tool. Each constraint tube body has multiple slots defined along a longitudinal direction thereof and equally distributed thereon.

BRIEF DESCRIPTION OF THE DRAWINGS

The other advantages and/or benefits caused by the present invention will become patently apparent after reading the following detailed description of illustrative preferred embodiments of the invention together with referring to the associated drawings in which.

DETAILED DESCRIPTION OF THE PREFERRED EMBODIMENT

Figure 1:
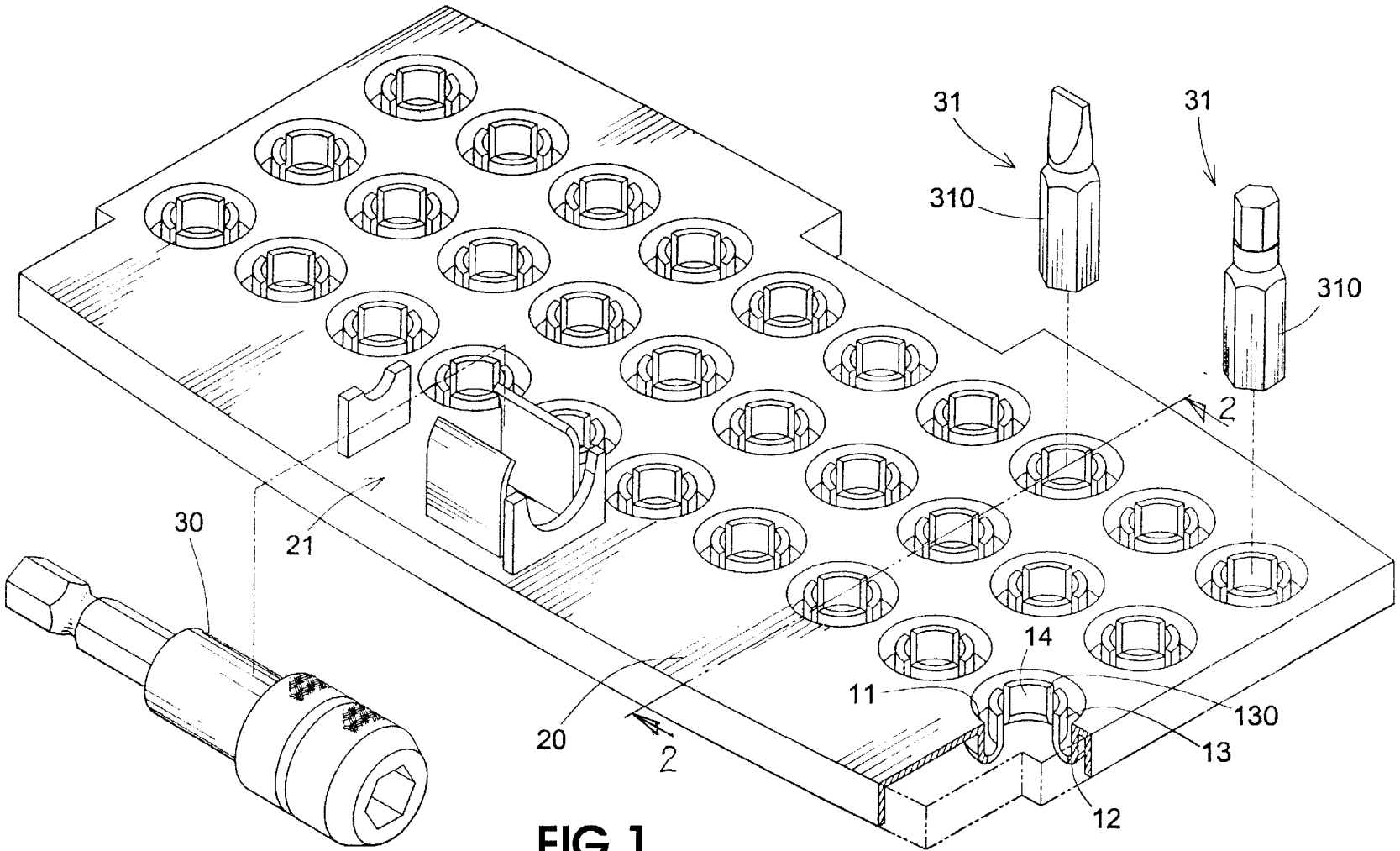
FIG. 1 is a schematically perspective view of the preferred embodiment of a flexible tool storage device in accordance with the present invention.
Figure 2:
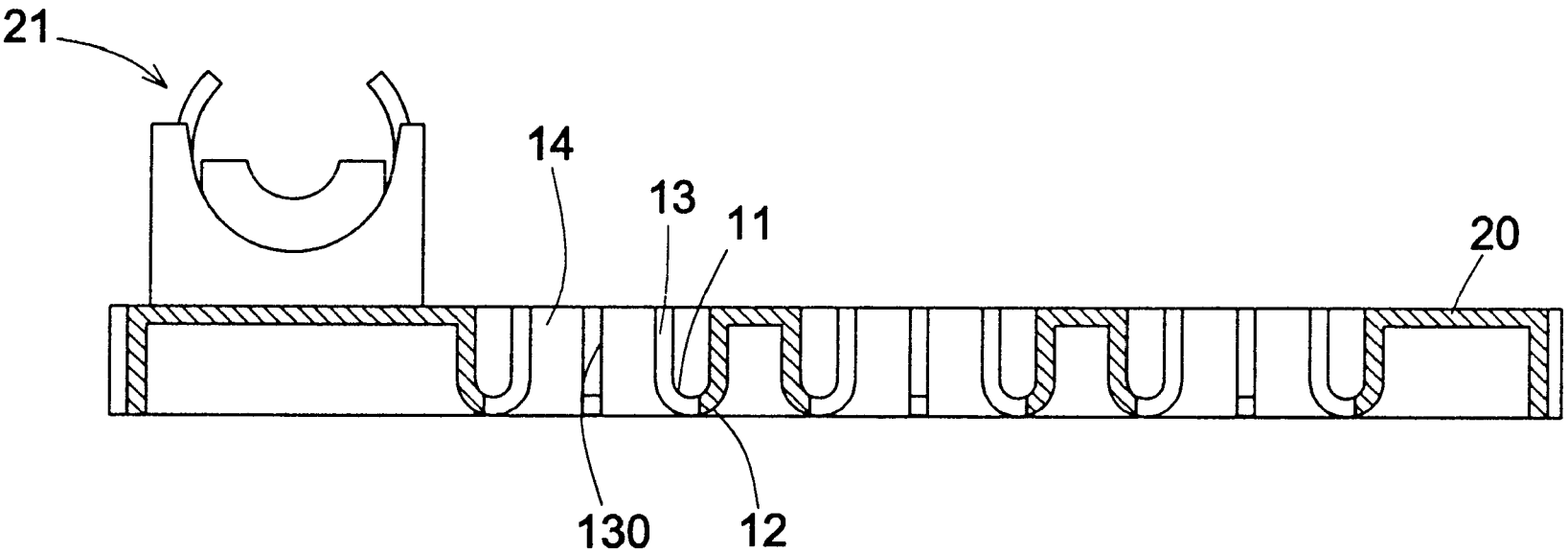
FIG. 2 is a cross section view of the flexible storage device of FIG. 1 along line 2—2.
Figure 3:
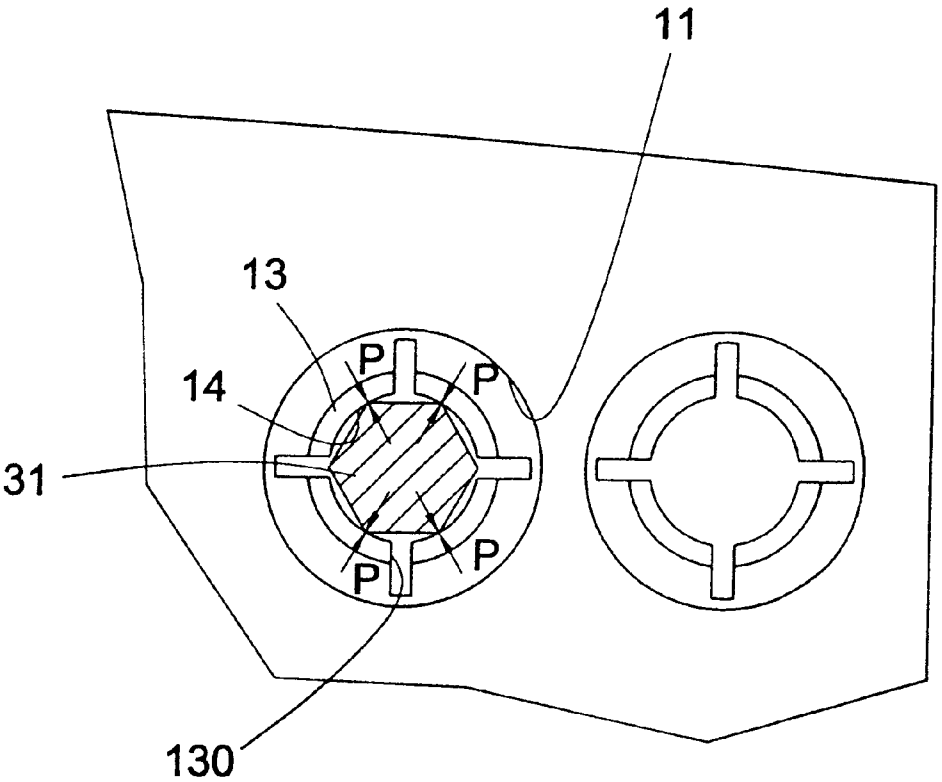
FIG. 3 is partially top view of the flexible storage device of FIG. 1.

With reference to FIGS. 1–3, the preferred embodiment of the flexible tool storage device in accordance with the present invention includes a storage body 20.

The storage body 20 has multiple circular recesses 11 defined thereon. Each circular recess 11 has a connection bottom 12. An insert opening 14 is so defined inside of each circular recess 11 that each circular recess 11 has an internal diameter larger than a diameter of the insert opening 14, and that a cylindrical constraint tube body 13 is defined between each circular recess 11 and the insert opening 14 corresponding thereto.

The insert openings 14 each have a diameter slightly less than the diameter of an excircle of a shank 310 of the working portion 31.

Each constraint tube body 13 has an internal diameter slightly less than a diameter of an excircle of a shank 310 of a working portion 31 of a tool. Each constraint tube body 13 has multiple slots 130 defined along a longitudinal direction thereof and equally distributed thereon.

More preferredly, the storage body 20 has a chuck retainer 21 defined on a side of the storage body 20 to retain a chuck 30.

It is preferred that the working portion 310 has a cabinet tip or a Phillips head tip.

Figure 4:
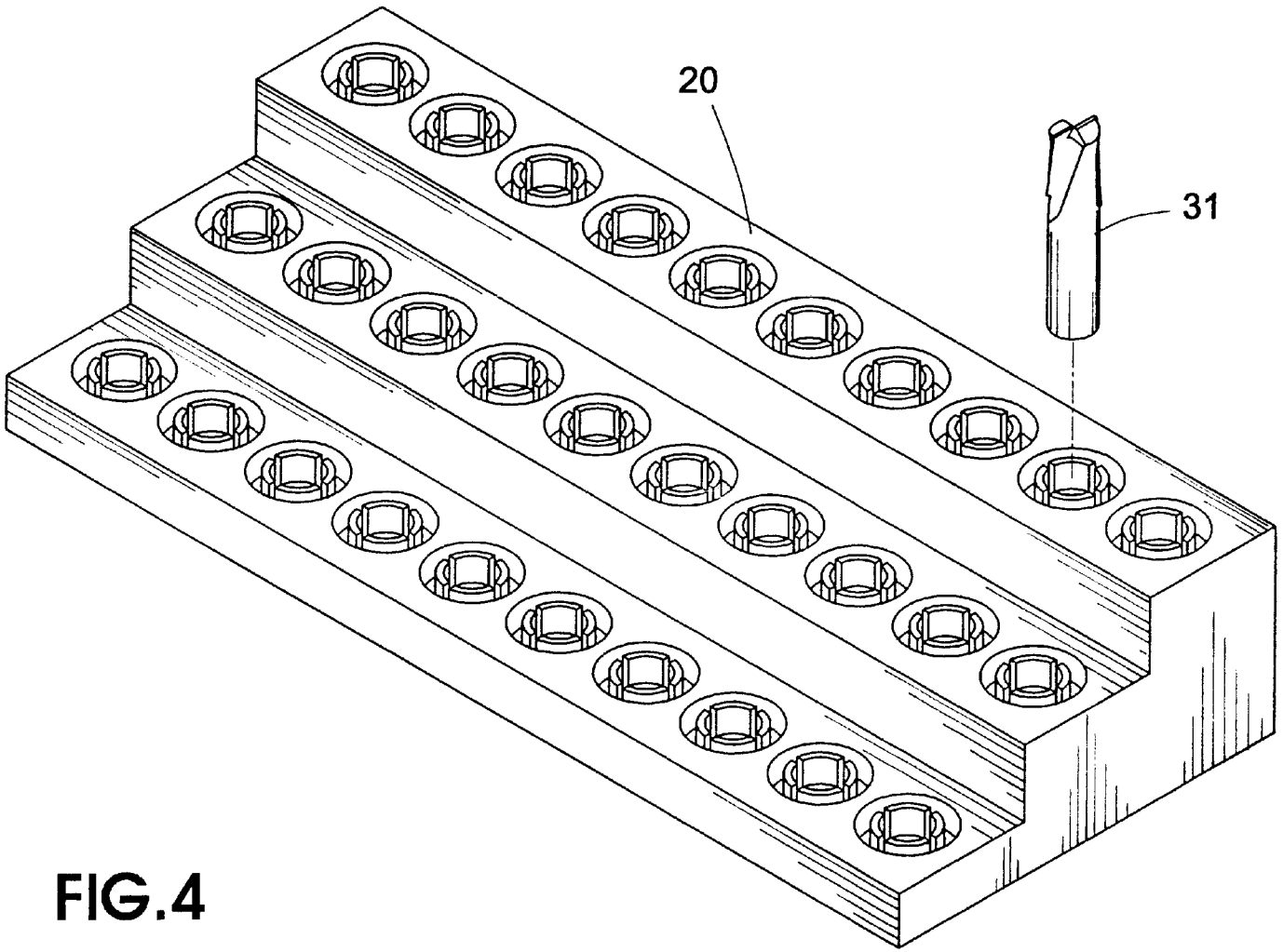
FIG. 4 is a schematically perspective view of the other embodiment of a flexible tool storage device in accordance with the present invention.

When a tool is inserted through the insert opening 14, the diameter of the insert opening 14 of the cylindrical constraint body 13 will be slightly enlarged by the shank 310, since the diameter of the insert opening 14 is smaller than that of the excircle of the shank 310 of the work portion 31. The slots 130 defined on the constraint tube body 13 facilitate in providing flexibility so that the insert opening 14 is more liable to be enlarged. Meanwhile, a recovery force against the shank 310 is provided from the bent walls of the constraint tube body 13. Thus, a constraint force P is urged to the shank 310 from the constraint tube body 13. The shank 310, thus, can be stably retained in the flexible tool storage device. When one desires to draw out a work portion 31 from the flexible tool storage device, he can easily draw the working portion 31 out of the insert opening 14. Through the help of the slots 130, the insert opening 14 can recover to an original state more easily. Thus, the abrasion between the working portion 31 and the inner wall of the insert opening 14 is reduced so that a longer life of the flexible tool storage device is achieved With reference to FIG. 4, the storage body 20 is a ladder and the working portion 31 has an end mill tip.

Figure 5:
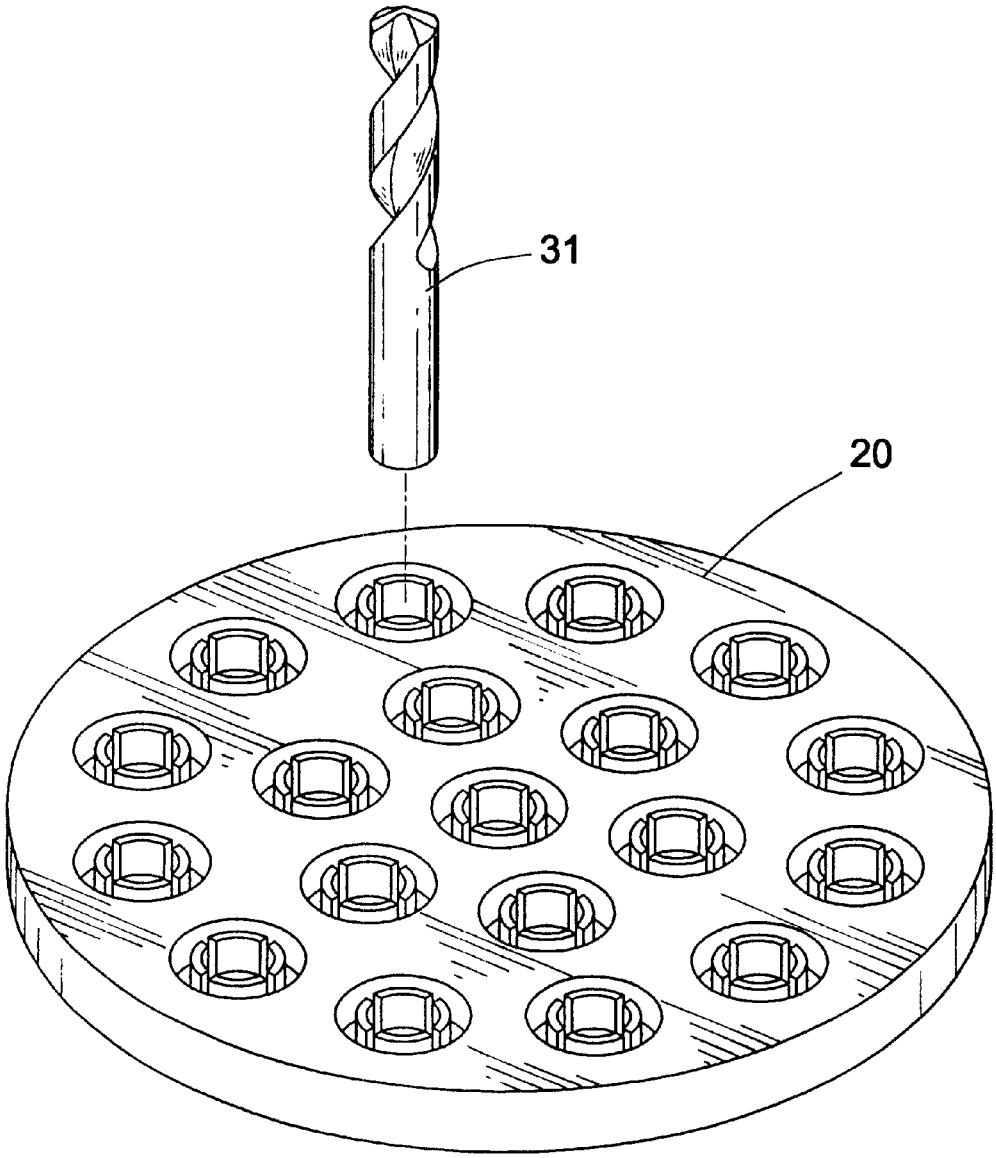
FIG. 5 is a schematically perspective view of the other embodiment of a flexible tool storage device in accordance with the present invention.
Figure 6:
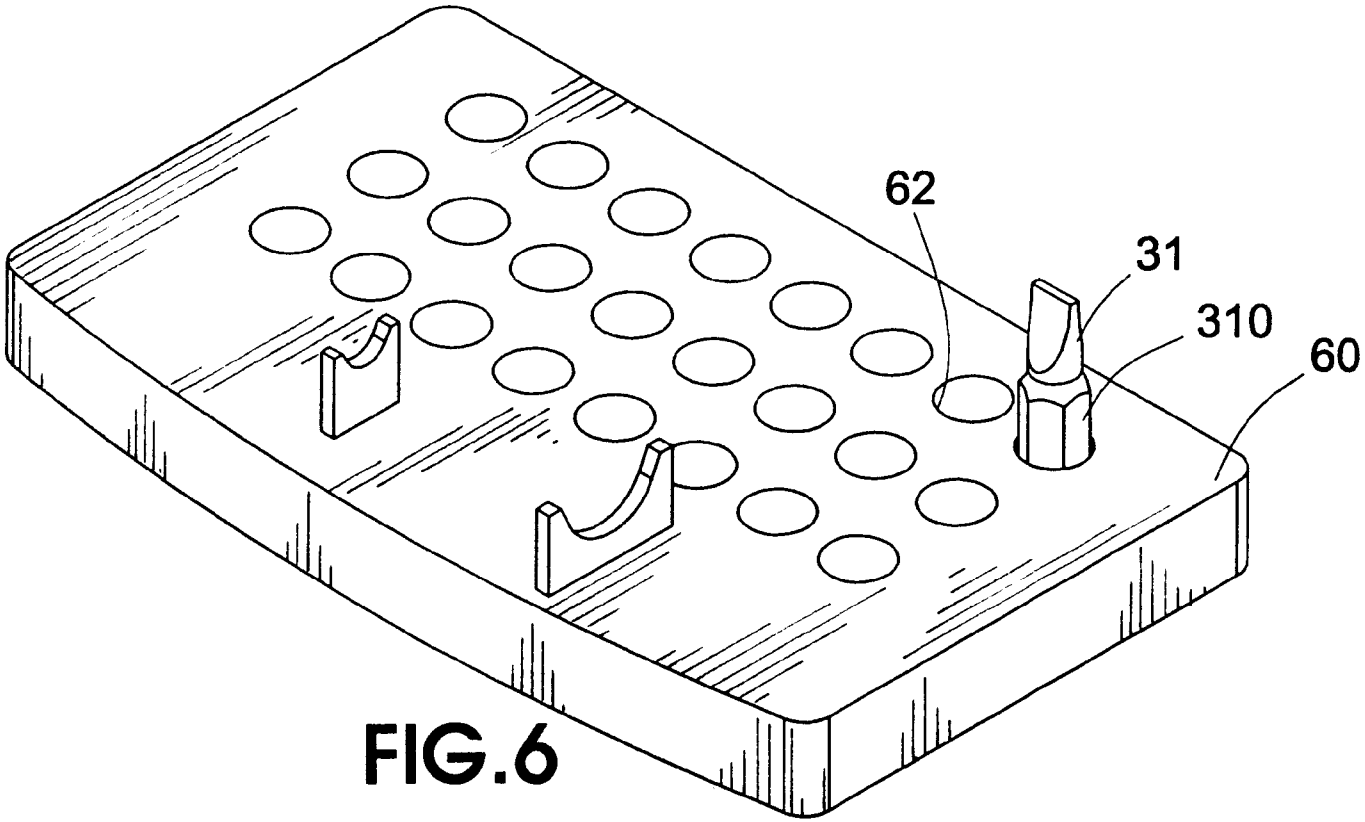
FIG.6 PRIOR ART
FIG. 6 is schematically perspective view of a tool storage device of prior art.

With reference to FIG. 5, the storage body 20 is a round plate and the working portion 31 is a drill.

Having thus detailedly described the preferred embodiment of the present invention, it will become apparently to those skilled in the art that the detailed description of the preferred embodiment of the present invention is illustrative only and thus various modifications, changes and substitutions can be made without departing from the spirit of the following claims of the present invention. All of such modifications, changes and substitution as stated above are still within the scope of the present invention.

What is claimed is:

1. A flexible tool storage device comprising:

a storage body having multiple circular recesses defined therein, the storage body having a side provided with a chuck retainer; and an insert opening defined inside of each circular recess, each circular recess having an internal diameter larger than a diameter of the insert opening whereby a cylindrical constraint tube body is defined between each circular recess and the insert opening corresponding thereto, each constraint tube body having an internal diameter slightly less than a diameter of an excircle of a shank of a working portion of a tool and having multiple slots defined along a longitudinal direction thereof and equally distributed thereon.

2. The flexible tool storage device as claimed in claim 1, wherein the storage body is a plate.

3. The flexible tool storage device as claimed in claim 1, wherein the storage body is a ladder.

4. The flexible tool storage device as claimed in claim 1, wherein the storage body is a round plate.

* * * * *